US006350104B1

(12) United States Patent
Moreau et al.

(10) Patent No.: US 6,350,104 B1
(45) Date of Patent: Feb. 26, 2002

(54) FAN BLADE

(75) Inventors: Stéphane Moreau, Paris; Bruno Dessale, Mandelieu; Eric Coggiola, Paris, all of (FR)

(73) Assignee: Valeo Thermique Moteur, La Verriere Cedex (FR)

( * ) Notice: Subject to any disclaimer, the term of this patent is extended or adjusted under 35 U.S.C. 154(b) by 0 days.

(21) Appl. No.: 09/509,473

(22) PCT Filed: Jul. 28, 1999

(86) PCT No.: PCT/FR99/01861

§ 371 Date: Mar. 28, 2000

§ 102(e) Date: Mar. 28, 2000

(87) PCT Pub. No.: WO00/06913

PCT Pub. Date: Feb. 10, 2000

(30) Foreign Application Priority Data

Jul. 28, 1998 (FR) ..... 98 09648

(51) Int. Cl.[7] ..... F04D 29/38

(52) U.S. Cl. ..... 416/192; 416/238; 416/169 A; 416/DIG. 2; 416/189

(58) Field of Search ..... 416/192, 189, 416/238, 223, 169 A, 243, 237, DIG. 2, DIG. 5, 234

(56) References Cited

U.S. PATENT DOCUMENTS 5,399,070 A * 3/1995 Alizadeh ..... 416/189
5,423,660 A * 6/1995 Sortot ..... 416/189
5,577,888 A 11/1996 Capdevila et al. ..... 415/210.1
5,769,607 A * 6/1998 Neely et al. ..... 416/189
5,957,661 A * 9/1999 Hunt et al. ..... 416/192

FOREIGN PATENT DOCUMENTS

| | | | |
|---|---|---|---|
| DE | 3335649 A1 * | 4/1985 |
| EP | 0 096 255 | 12/1983 |
| EP | 0 553 598 | 8/1993 |
| EP | 0 569 863 | 11/1993 |
| EP | 0 704 652 | 4/1996 |
| WO | 91/02165 | 2/1991 |
| WO | 91/05169 | 4/1991 |

OTHER PUBLICATIONS

Eric Coggiola, "On the Use of CFD in the Automotive Engine Cooling Fan System Design", American Institute of Aeronautics and Astronautics, No. 0772 Jan. 12, 1998, pp. 1–10.

French Search Report dated Oct. 29, 1999.

* cited by examiner

*Primary Examiner*—Edward K. Look
*Assistant Examiner*—Richard Woo
(74) *Attorney, Agent, or Firm*—Morgan & Finnegan, LLP

(57) ABSTRACT

The invention concerns a blade having an axial length L, expressed in meters, equal by approximately 20%, to the value of $L_0$ given by the following formula (I): $L_0=0.426262-5.14288.D+23.1798.D^2-44.2505.D^3+30.8841.D^4$, D being the blade diameter expressed in meters. The invention enables to substantially reduce the blade axial space requirement, for a given diameter and for obtaining the desired performance. The invention is useful for cooling a motor vehicle engine.

24 Claims, 4 Drawing Sheets

FAN BLADE

BACKGROUND OF THE INVENTION

The invention relates to a fan propeller comprising a boss and blades that extend radially outwards from the boss, the boss being suitable be fixed to the shaft of a motor so as to allow the motor to transmit a power of at least 150 watts to the propeller.

Such propellers are used in particular for the cooling of the driving engine of automotive vehicles, the propeller producing a flow of air through a cooling radiator.

It was assumed until now that the aeraulic and acoustic performances of such blades are better because their diameter and their axial length are greater.

As the available space in the engine compartment of vehicles is generally very limited, it is desirable to have cooling propellers of reduced spatial requirement, in particular in the axial direction.

Surprisingly, it has been discovered that, for a given diameter, the aeraulic and acoustic performances in practice only deteriorate beneath a certain optimal axial length.

BRIEF SUMMARY OF THE INVENTION

The invention relates in particular to a propeller of the type defined in the introduction, and specifies that its axial length L, measured in metres, is not appreciably higher than the value $L_0$ given by the following formula (I):

$$L_0=0.426262-5.14288.D+23.1798.D^2-44.2505.D+30.8841.D^4,$$

D being the diameter of the propeller measured in metres.

At least for certain geometric configurations of the blades, it is preferable for L not to be appreciably less than $L_0$, as beneath this value performances decrease.

The upward and, if necessary, the downward range of variation of L in relation to $L_0$ is 20 %.

The above variations apply particularly when the geometric configuration of the propeller has at least some of the following characteristics:

- The axial ends of the blades and of the boss that are turned downstream from the flow of air produced by the propeller are roughly contained in the same radial plane.
- The trailing edge of the blades is entirely contained in the said radial plane.
- The axial ends of the blades and of the boss that are turned upstream from the flow of air produced by the propeller are roughly contained in the same radial plane.
- The radially outer ends of the blades are connected to one another by a collar.
- The blades are roughly identical to one another and uniformly spaced in the circumferential direction along an angular pitch β, the point situated halfway between the leading and trailing edges at the radially outer end being offset in relation to the corresponding point at the base of the blade, in the opposite direction to the direction of rotation of the propeller, by an angle α of between roughly one half and three quarters of the angular pitch. This relates to the case of propellers known as symmetrical propellers.
- The leading and trailing edges of each blade are convex in the direction of rotation of the propeller, the point situated half way between them progressively moving to the rear of the axial plane containing its position at the foot of the blade, then progressively returning right into this plane, over a fraction of the radial span of the blade of between 20 and 70%, and progressively moving forwards away from this same plane over the remaining fraction.
- The acute angle Ω between the chord of the flattened cross section of a blade and a radial plane decreases progressively at least over the last 30% of the radial span of the blade.
- The boss comprises a roughly cylindrical wall from which the blades extend, and a base wall disposed substantially along a radial plane, turned downstream from the air flow produced by the propeller, the cylindrical wall and the base wall being connected to one another by a convex curved portion having a radius of curvature of between 4 and 8 mm.
- The rounded portion roughly has a contour like a quarter of a circle with a radius of 5 mm.
- The blades extend over the whole axial length of the cylindrical wall of the boss.
- The boss is hollow and internally has ribs.

BRIEF DESCRIPTION OF THE DRAWING

The characteristics and advantages of the invention will be explained in further detail in the following description, with reference to the attached drawings, on which.

DETAILED DESCRIPTION OF THE INVENTION

Figure 1:
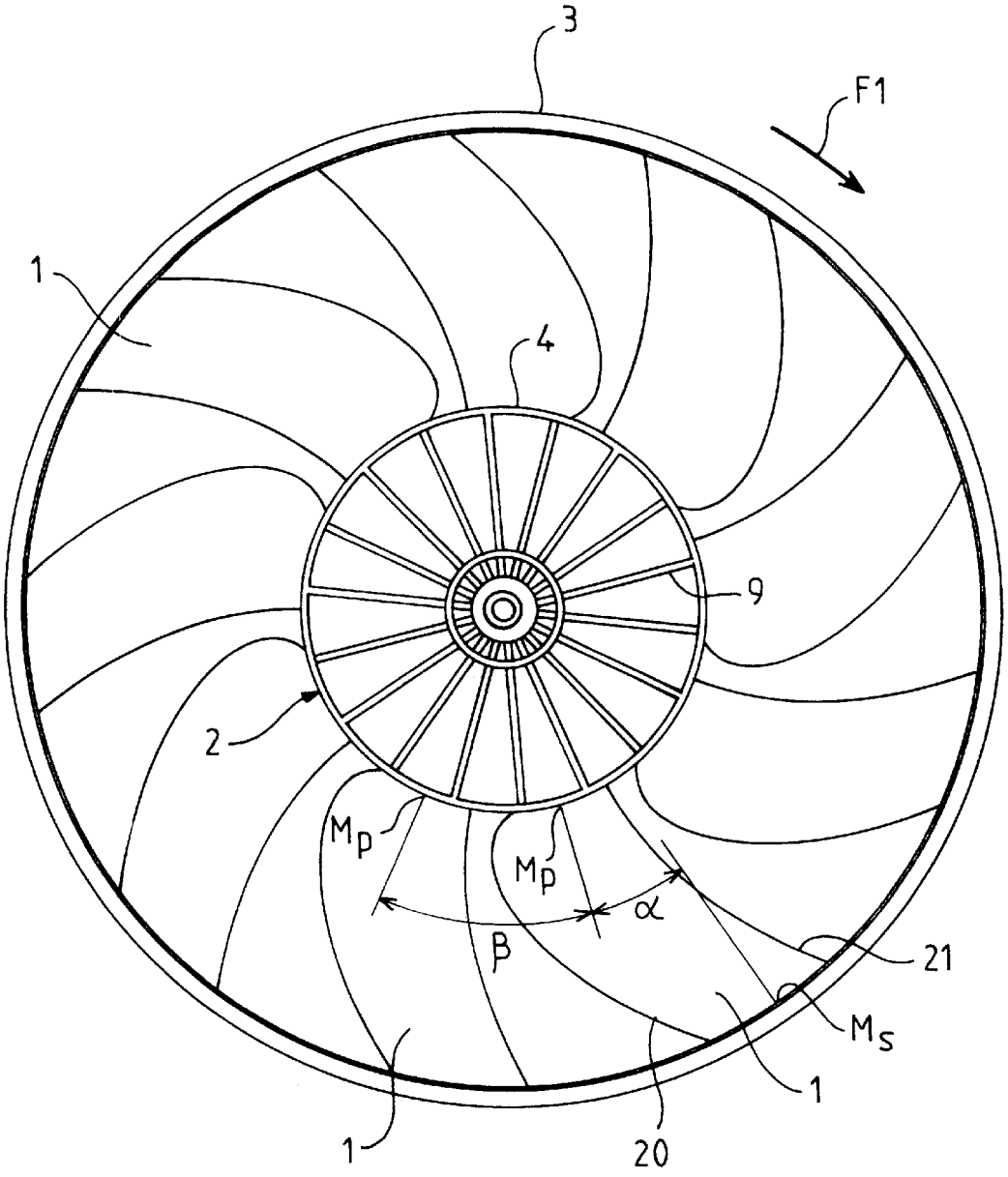
FIG. 1 is an axial rear view of a fan propeller according to the invention.
Figure 2:
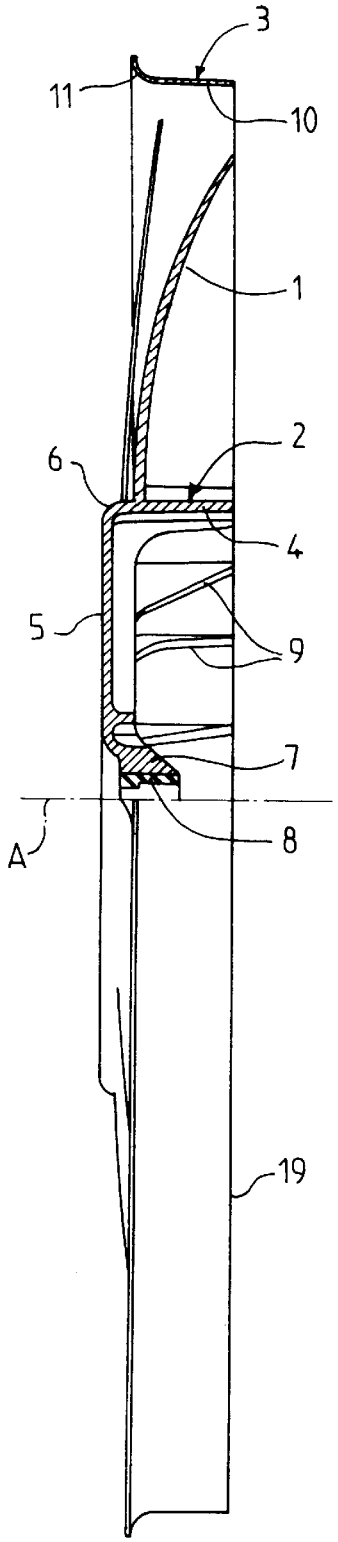
FIG. 2 is a side view in axial half-section of the propeller.

The propeller illustrated in FIGS. 1 to 4 comprises, in the conventional manner, a multiplicity of blades 1 that generally extend radially from a central boss 2 and are interconnected by a collar 3 at the periphery of the propeller. The boss, the blades and the collar are formed from a single piece by moulding. The boss 2 has a cylindrical annular wall generated by rotation 4, to which the bases of the blades 1 are connected, and a plane front wall 5, turned upstream, the terms upstream and downstream here referring to the direction of the air flow produced by the rotation of the propeller. The walls 4 and 5 are connected to one another by a curved portion 6 having a contour like an arc of a circle with a radius of 5 mm. In the direction of axis A of the propeller, the wall 5 is connected to a central sleeve 7 moulded onto a metallic annular insert 8 intended for the connection of the propeller to the shaft of a driving engine, not represented. Reinforcing ribs 9 are provided inside the boss 2. The collar 3 also has a cylindrical annular wall generated by rotation 10, to which the ends of the blades are attached, and which is continued, from the upstream side, by a rounded flare 11.

The axial ends of the boss and of the collar turned downstream from the flow of air and the trailing edge of the blades are contained in the same radial plane 19. On the other hand, the wall 5 of the boss, which, on FIG. 1, represents the axial end thereof at the upstream side, is disposed projecting in relation to the corresponding end of the collar 3. As for the position of the leading edge of the blades, it moves progressively downstream from the base of the blades, where it is situated at the upstream end of the cylindrical wall 4, i.e. 5 mm downstream from the upstream face of the wall 5, right to the vicinity of the upstream end of the cylindrical wall 10.

According to the invention, as is seen on FIG. 1, the point M, situated halfway between the leading edge 20 and the trailing edge 21 of a blade 1, at the radially outer end thereof, is offset by an angle $\alpha$, in the direction of rotation of the propeller, indicated by the arrow F1, in relation to the point $M_p$ situated half way between the leading and trailing edges at the base of the blade. The angle $\alpha$ is advantageously between roughly one half and three quarters of the angular pitch $\beta$ of the blades.

Figure 4:
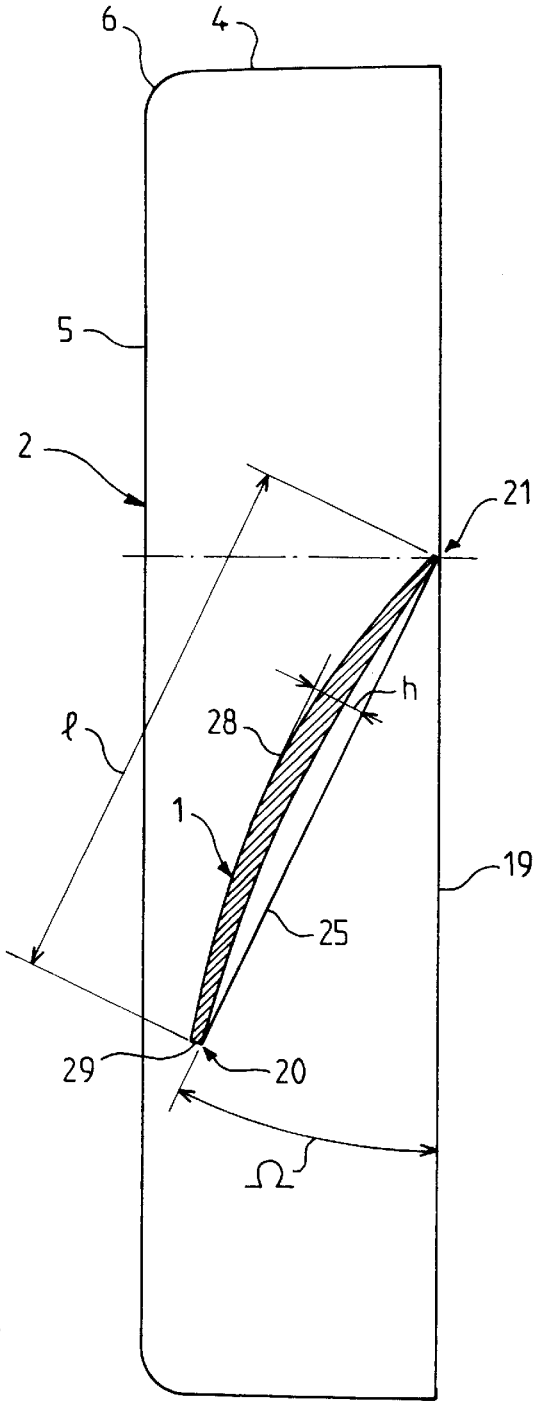
FIG. 4 is a top view of the boss of the propeller, also showing the shape of the flattened cross section of a blade.
Figure 3:
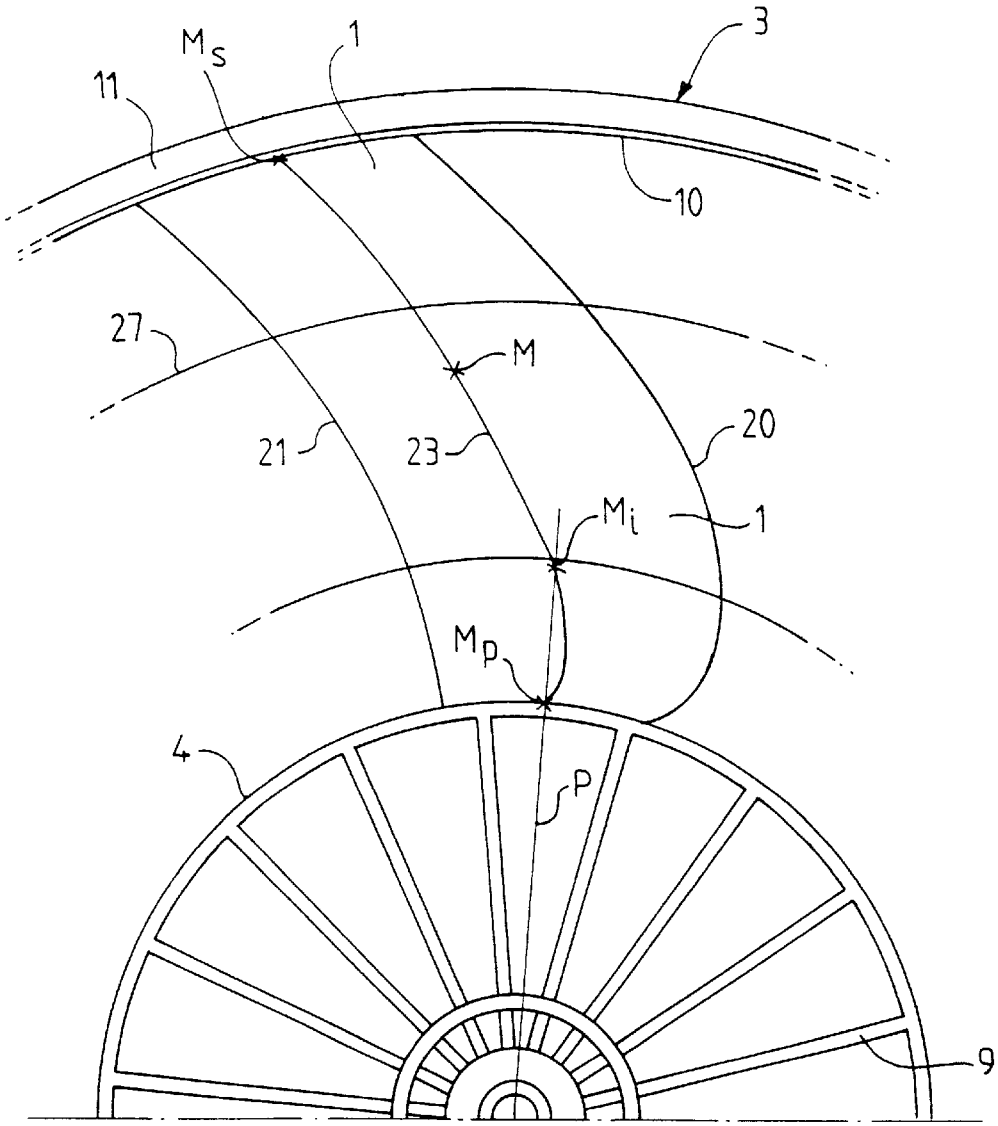
FIG. 3 is an enlarged portion of FIG. 1.

It can also be seen on FIGS. 1 and 3 that the trailing edge 21 and the leading edge 20 of the line 23 progressively moves to the rear of the axial plane P that contains it, then progressively returns to cut the plane P at point $M_i$. It then progressively moves forwards from this same plane, to the point $M_s$. The distance between the points $M_p$ and $M_i$ represents between 20 and 70% of the radial span of the blades, i.e. of the distance between the cylindrical walls 4 and 10. FIG. 4 shows the flattened cross section of a blade, i.e. the plane closed curve obtained by cutting the blade through a cylindrical surface generated by rotation around the axis A of the propeller, and by unrolling this cylindrical surface flat. This flattened cross section has a contour like an aeroplane wing, the chord 25 of which is inclined by an acute angle $\Omega$ in relation to a radial plane such as the plane 19 containing the downstream end of the propeller. The invention specifies that the angle $\Omega$, or blade angles, progressively decreases over the last 30% of the radial span of the blade, i.e. from the cylindrical surface 27 indicated on FIG. 3 to the wall 10, the distance between the surface 27 and the wall 10 representing 30% of the distance between the walls 4 and 10.

Advantageously, the point 28 of the flattened cross section which is the furthest from the chord 25 is substantially at equal distance from the ends thereof, whereas the distance h between the point 28 and the chord 25 is at least equal to 3% of the length 1 thereof, and in particular equal to 10% of this length.

Figure 7:
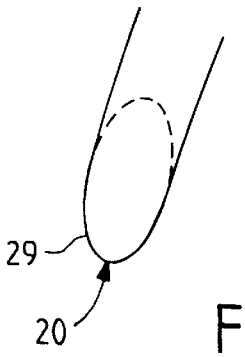
FIG. 7 shows on a larger scale than FIG. 4 the flattened cross section of the blade in the vicinity of the leading edge thereof.

FIG. 7 shows, on a larger scale, the region of the flattened cross section of the blade adjacent to the leading edge. According to the invention, the contour of the blade comprises an elliptical arc 29 in this region, the ratio of the axes of the ellipse being greater than 1.5.

Figure 5:
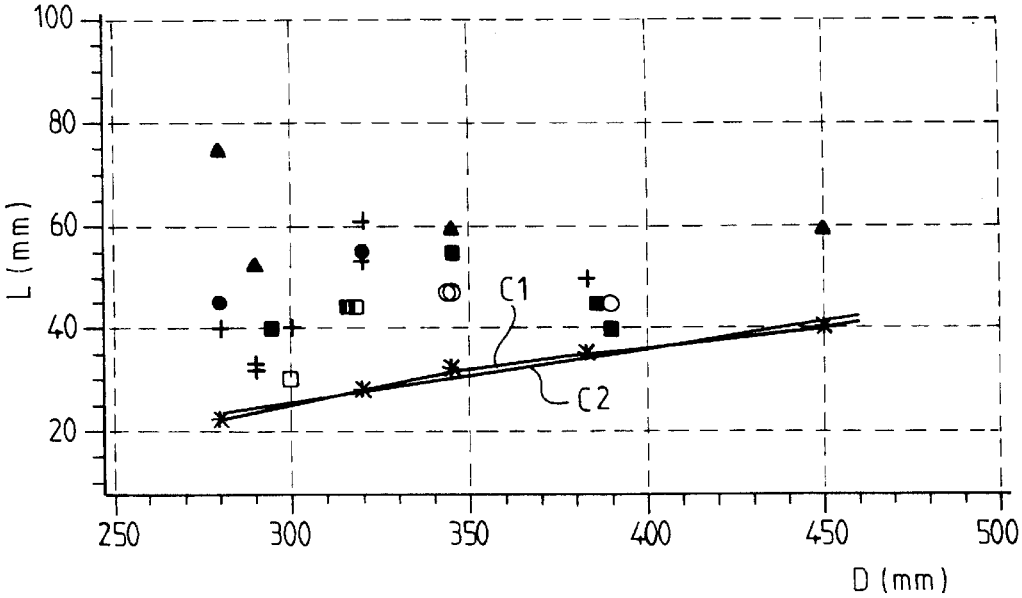
FIGS. 5 and 6 are graphs illustrating the axial length as a function of the diameter for known fan propellers and for fan propellers according to the invention.

On the graph of FIG. 5, each of the points marked by a cross, a triangle, a square or a circle has the diameter and the axial length, in millimetres, of the propeller of a commercially available cooling fan for the coordinates.

The following table gives the axial length and the maximum efficiency for fan propellers that have normal diameters for the cooling of engines of motor vehicles, i.e. 280, 320, 350, 380 and 450 mm. The maximum efficiency is the maximum value of the efficiency obtained by varying the rotational speed of the fan. For each diameter, the table relates to five propellers designated by the references 1 to 5, the first four being commercially available propellers and the fifth being a propeller in accordance with the invention. Some of the propellers bearing references 1 to 4 correspond to points marked on FIG. 5.

| | Reference | | | | |
|---|---|---|---|---|---|
| | 1 | 2 | 3 | 4 | 5 |
| Diameter 280 mm | | | | | |
| axial length (mm) | 45 | 32 | 42 | 50 | 22 |
| maximum efficiency (%) | 54 | 45 | 49 | 52 | 59 |
| Diameter 320 mm | | | | | |
| axial length (mm) | 53 | 32 | 44 | 44 | 28 |
| maximum efficiency (%) | 50 | 47 | 55 | 55 | 55 |
| Diameter 350 mm | | | | | |
| axial length (mm) | 38 | 47 | 47 | 55 | 32 |
| maximum efficiency (%) | 50 | 47 | 51 | 51 | 54 |
| Diameter 380 mm | | | | | |
| axial length (mm) | 42 | 40 | 40 | 45 | 35 |
| maximum efficiency (%) | 55 | 55 | 54 | 56 | 59 |
| Diameter 450 mm | | | | | |
| axial length (mm) | 54 | 89 | 52 | 60 | 40 |
| maximum efficiency (%) | 56 | 47 | 52 | 56 | 56 |

The propellers bearing the reference 5 have been defined by the computational method known by the designation "Computational Fluid Dynamics" (CFD), described by Eric Coggiola et al. in AIAA article 98-0772 "On the use of CFD in the automotive engine cooling fan system design" presented to Aerospace Sciences Meeting and Exhibit, at Reno, USA, Jan. 12 to 15 1998.

On FIG. 5, the points corresponding to the propellers bearing reference 5 are indicated by stars with eight points. The formula (I) is none other than the equation of the curve C1 which passes roughly through these points. In the range considered, i.e. for diameters of between roughly 0.2 and 0.5 m, this equation may in practice be replaced by the approximate linear equation (II):

$$L_0=-0.00584+0.105.D$$

Figure 6:
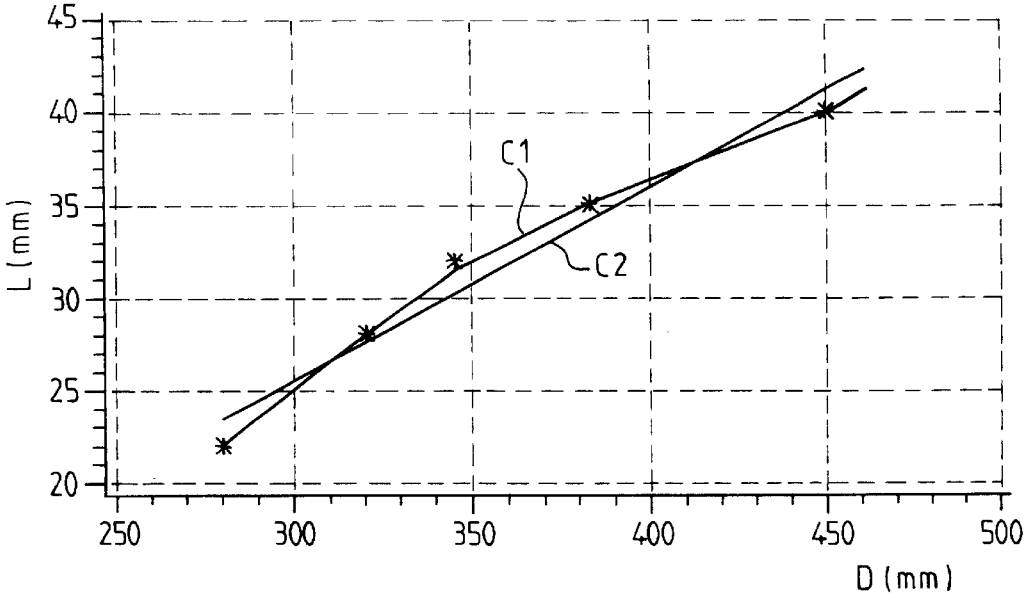

$L_0$ and D being measured in metres. The representative straight line of this equation is represented at C2 on FIG. 5. The curves C1 and C2 are reproduced on FIG. 6, with a larger scale for the Y-axis.

It is seen on FIG. 5 that, for a given diameter, the axial length of the existing propellers is higher, sometimes very substantially, than the value $L_0$ given by the formula I. It is also seen on the table that the maximum efficiency of the propeller according to the invention, for a given diameter, is higher than, or almost equal to, the maximum efficiency of the known propellers, a slight superiority of the latter only being obtained, in these borderline cases, at the price of a substantially higher axial spatial requirement.

What is claimed is:

1. A fan propeller for cooling a motor vehicle engine comprising a boss and blades extending radially outwards from the boss, the boss being capable of being fixed to the shaft of a motor so as to enable the motor to transmit a power of at least 150 watts to the propeller, wherein the propeller has an axial length L, measured in meters, that is less than or roughly equal to a value $L_0$, where $$L_0=0.426262-5.142\ 88.D+23.1798.D^2-44.2505.D^3+30.8841.D^4,$$

D being the diameter of the propeller measured in meters.

2. A propeller according to claim 1, wherein L is substantially equal to $L_0$.

3. A propeller according to claim 2, wherein L does not deviate from $L_0$ by more than 20%.

4. A propeller according to claim 2, wherein axial ends of the blades and of the boss that are turned downstream from the flow of air produced by the propeller are roughly contained in the same radial plane.

5. A propeller according to claim 1, wherein L does not deviate from $L_0$ by more than 20%.

6. A propeller according to claim 5, wherein axial ends of the blades and of the boss that are turned downstream from the flow of air produced by the propeller are roughly contained in the same radial plane.

7. A propeller according to claim 5, wherein axial ends of the blades and of the boss that are turned upstream from the flow of air produced by the propeller are roughly contained in the same radial plane.

8. A propeller according to claim 5, wherein radially outer ends of the blades are connected to one another by a collar.

9. A propeller according to claim 1, wherein axial ends of the blades and of the boss that are turned downstream from the flow of air produced by the propeller are roughly contained in the same radial plane.

10. A propeller according to claim 9, wherein the blades have a trailing edge that is entirely contained in the said radial plane.

11. A propeller according to claim 10, wherein axial ends of the blades and of the boss that are turned upstream from the flow of air produced by the propeller are roughly contained in the same radial plane.

12. A propeller according to claim 10, wherein radially outer ends of the blades are connected to one another by a collar.

13. A propeller according to claim 9, wherein axial ends of the blades and of the boss that are turned upstream from the flow of air produced by the propeller are roughly contained in the same radial plane.

14. A propeller according to claim 9, wherein radially outer ends of the blades are connected to one another by a collar.

15. A propeller according to claim 1, wherein axial ends of the blades and of the boss that are turned upstream from the flow of air produced by the propeller are roughly contained in the same radial plane.

16. A propeller according to claim 15, wherein radially outer ends of the blades are connected to one another by a collar.

17. A propeller according to claim 1, wherein radially outer ends of the blades are connected to one another by a collar.

18. A propeller according to claim 1, wherein the blades are roughly identical to one another and uniformly spaced in the circumferential direction along to an angular pitch β, a point ($M_s$) situated half way between the leading and trailing edges at the radially outer end being offset in relation to the corresponding point ($M_p$) at the base of the blade, in the direction opposite to the direction of rotation (F1) of the propeller, by an angle of between roughly one half and three quarters of the said angular pitch.

19. A propeller according to claim 1, wherein the leading and trailing edges of each blade are convex in the direction of rotation of the propeller, the point (M) situated half way between them progressively moving towards the rear of the axial plane (P) containing its position ($M_p$) at the base of the blade, then progressively returning right into this plane, over a fraction of the radial span of the blade of between 20% and 70%, and progressively moving forwards away from this same plane over the remaining fraction.

20. A propeller according to claim 1, wherein the acute angle $\mathcal{A}$ between the chord of the flattened cross section of a blade and a radial plane progressively decreases at least over the last 30% of the radial span of the blade.

21. A propeller according to claim 1, wherein the boss comprises a roughly cylindrical wall from which the blades extend, and a base wall disposed roughly along a radial plane, turned upstream from the flow of air produced by the propeller, the cylindrical wall and the base wall being connected to one another by a convex curved portion having a radius of curvature between 4 and 8 mm.

22. A propeller according to claim 21, wherein the curved portion roughly has a contour like a quarter of a circle with a radius of 5 mm.

23. A propeller according to claim 11, wherein the blades extend over the entire axial length of the cylindrical wall of the boss.

24. A propeller according to claim 1, wherein the boss is hollow and internally has ribs.

* * * * *